United States Patent [19]

Erdell

[11] 3,971,929

[45] July 27, 1976

[54] SAFELIGHT FILTER

[76] Inventor: John Buckland Erdell, 50 Morningside Drive, New York, N.Y. 10025

[22] Filed: Apr. 28, 1975

[21] Appl. No.: 571,985

Related U.S. Application Data

[63] Continuation-in-part of Ser. No. 429,860, Jan. 2, 1974, abandoned.

[52] U.S. Cl. ..... 240/10.6 R; 240/10.66; 240/20

[51] Int. Cl.[2] ..... F21V 9/00; F21L 15/04

[58] Field of Search ..... 240/20, 1.3, 10.6, 10.66; 355/35, 71

[56] References Cited

UNITED STATES PATENTS

| | | | |
|---|---|---|---|
| 2,263,684 | 11/1941 | Ryan | 240/20 |
| 2,297,974 | 10/1942 | Moore | 240/20 |
| 2,734,435 | 2/1956 | Leonardi | 240/20 |
| 2,997,389 | 8/1961 | Boon | 355/35 X |
| 3,405,262 | 10/1968 | Dolan et al. | 240/20 |

*Primary Examiner*—Joseph F. Peters, Jr.
*Attorney, Agent, or Firm*—Stoll and Stoll

[57] ABSTRACT

The invention comprises a darkroom safelight having (a) a light filter consisting of negative color film which has been exposed to a white light source (such as a generally continuous, uninterrupted light-reflective surface illuminated by white light) and then developed with color developer, and (b) at least two color filters selected from the colors of magenta, cyan and yellow. The minimum densities of these color filters are determined by the work-fogging factor; the maximum densities are determined by the factor of visual illumination of the work area.

9 Claims, 8 Drawing Figures

SAFELIGHT FILTER

REFERENCE TO RELATED APPLICATION

This is a continuation-in-part of pending U.S. Pat. application Ser. No. 429,860 filed on Jan. 2, 1974 by the present applicant and now abandoned.

BACKGROUND OF THE INVENTION

1. Field of the Invention

This invention relates to the developing and processing of photographic film and print paper, and especially, but not exclusively, to the development and processing of color film and paper.

2. Brief Description of Prior Art

Safelights for darkroom use in connection with the development and processing of black-and-white film and print paper are well-known to the art. They perform their intended function (when properly used) without adverse effect, i.e., fogging, upon the film or print paper being developed. However, no satisfactory safelight for color film and print paper developing has heretofore been perfected. In all cases known to applicant, conventional safelights for color processing transmit so little light that it is difficult to inspect the film or print paper being processed. Not only is the illumination level extremely low, but the exposure time for each inspection period must be kept relatively short to prevent fogging of the light-sensitive material.

As an example, the processing of color print paper requires the use of an unusually dense safelight filter such as that marketed by the Eastman Kodak Company under the trademark KODAK NO. 10. This is a very dark amber filter which may be used with color-negative paper, color slide and print material and panchromatic paper. The filter is normally used with a fifteen-watt incandescent lamp and is positioned no closer than four feet from the light-sensitive material which is to be inspected. The light available under these conditions is extremely limited, and inspection of the light-sensitive material and any photographic image thereon is difficult. Increasing the wattage of the light source or reducing the distance between the light source and the light-sensitive material being processed is likely to result in fogging of the light-sensitive material.

The closest prior patent art known to applicant consists of the following U.S. Pat. Nos.:

| | |
|---|---|
| Ryan | No. 2,263,684 |
| McClees | No. 2,979,601 |
| Wood | No. 1,649,638 |
| Thomas | No. 2,431,091 |
| Metcalfe | No. 3,342,119 |
| Strong | No. 2,603,133 |
| Potter | No. 2,356,694 |
| Engelage | No. 3,107,578 |
| Yutzy | No. 3,497,350 |

The McClees U.S. Pat. No. 2,979,601 teaches the making of a light filter by exposing photographic film to a controlled light source and then developing same. But it does not appear that this patent teaches the use of a color negative film exposed to white light and developed with color developer and used in combination with color filters as a safelight filter. The McClees filter is not intended to function as a darkroom safelight filter and it is incapable of performing that function.

The remaining prior art patents above cited show various kinds of light filters, including filters for darkroom safelights, e.g., Ryan U.S. Pat. No. 2,263,684 which teaches the use of polarized filters for that purpose. But there is no teaching in Ryan, or in any of the other prior art references, of the use of color negative film (exposed to white light and developed with color developer) as a darkroom safelight filter in combination with color filters as herein disclosed.

OBJECTS OF THE INVENTION

Accordingly, it is an object of this invention to provide a safelight filter for panchromatic and color photographic materials, which safely yields a high level of visual illumination sufficient for inspection purposes in darkroom processing and developing, without danger of fogging the work.

It is another object of this invention to provide a safelight of the character described which may be permanently installed in a darkroom in the form, for example, of a 15-watt incandescent lamp fixture, or which may be fashioned as a portable battery-powered safelight to be held in the hand when in use.

SUMMARY OF THE INVENTION

The principle of the invention may be described as follows:

In conventional color photography, when an object is photographed by the use of negative color film with subsequent printing on positive color paper, light (white) areas in the object will appear as colored (amber) areas in the negative and as light (white) areas on the final print. Conversely, dark areas in the object will appear as light (white) areas in the negative and as dark (colored) areas in the final print. The colored (amber) areas in the negative effectively block out light during the step of printing on the color print paper, so that the portions on the print which correspond to the colored areas on the negative are not exposed and hence remain white.

It is evident from the foregoing that the colored (amber) areas on the negative film function as a screen or filter which blocks out light to which the light-sensitive print paper is sensitive and which transmits light to which the light-sensitive print paper is relatively insensitive, at least within reasonable time limitations.

In the present invention, the object which is photographed has an uninterrupted reflective surface, such as the surface of a sheet of white paper or a projection screen. When negative color film is exposed to an uninterrupted reflective surface, the entire light-sensitive surface of the negative will, on development, become colored (amber) and hence the entire negative will constitute a screen or filter capable of blocking out light which would normally affect a light-sensitive material. Hence, if conventional color print paper were exposed to such negative film, the entire light-sensitive surface of the print paper would, on development, become (or remain) white. It is this principle which enables the exposed and developed negative color film to be used as a light filter in a safelight.

It is this negative color film filter, in combination with color filters selected from the colors magenta, cyan and yellow, that comprises the present invention.

It should be understood that a single layer of negative color film will suffice for the purposes of this invention but two layers produce superior visual illumination. It should also be understood that the invention is not limited to the complementary subtractive colors magenta, cyan and yellow, but is also intended to include the use of filters in the primary colors red, blue and green. Thus, reference to a magenta filter plus a cyan filter should also be understood as a reference to a blue filter, and a reference to a magenta filter plus a yellow filter should also be understood as a reference to a red filter.

DESCRIPTION OF PREFERRED EMBODIMENTS OF INVENTION

Figure 1:
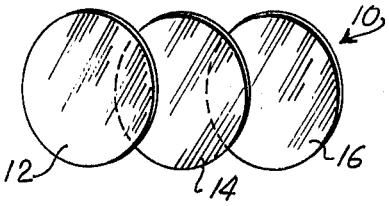
FIG. 1 is an exploded perspective view showing the three filter layers that comprise the filter element of the present invention.

FIG. 1 schematically shows a light filter assembly 10 made in accordance with the present invention, said assembly comprising three superposed filters 12, 14 and 16, each one of which may consist of one or more layers of the filter material.

Thus, filter 12 consists of at least one layer (preferably two layers) of color negative film (or equivalent light-sensitive material) exposed and processed in the manner hereinafter described. Preferably, the film employed is Kodak Ektacolor Type L or similar material. Ektacolor is a trademark of the Eastmen Kodak Company, and Kodak Ektacolor Type L is a color film made and sold by that company. This film is placed in a camera and exposed by photographing a substantially continuous, uninterrupted reflective surface such as a sheet of white paper or a projection screen suitably illuminated with 3200° K flood lamps, and developed in conventional manner. The result is an amber color image-free negative film which blocks light selectively in that spectrum range wherein the light would normally affect the light-sensitive surface of color print paper. Stated differently, the amber colored negative film prevents the light from fogging the color print paper.

The amber colored negative film may be exposed directly to the light source, or there may be an intervening diffuser layer such as ground glass. This is a conventional means for diffusing the light and is not shown in the drawing.

Supplementing filter 12 are filters 14 and 16 which are superposed on said filter 12. Filters 14 and 16 are selected from the colors magenta, cyan and yellow, either magenta and cyan, or magenta and yellow. Multiple layers may be used in each filter, e.g., two magenta layers, one of 30% density and one of 20% density may be combined to form a magenta filter of 50% density. Conversely, a single blue filter of 20% density may be used in the place and stead of one layer of magenta of 10% density and one layer of cyan of 10% density.

Color printing or color compensating filters of Eastman Kodak Company or of Agfa-Gevaert Co. Inc., or other standard color filters, may be used in this invention. For example, Kodak color printing filters CP-M (magenta), CP-C (cyan) and CP-Y (yellow) may be used for the purposes of the present invention, as may color filters prepared in accordance with the teachings of my U.S. Pat. No. 3,709,686, issued Jan. 9, 1973.

Figure 2:
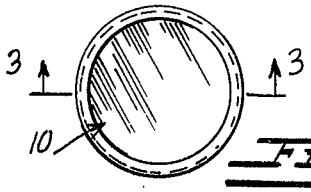
FIG. 2 is a face view of said filter element.
Figure 3:
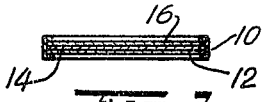
FIG. 3 is a section on the line 3—3 of FIG. 2.

One embodiment of the invention, shown in FIGS. 2 and 3, is an adaptation to a miniature flashlight commonly known as a penlight. Although the penlight can be of any desirable shape and size, penlight 18 shown in the drawing is intended to be representative of the various penlights to which the present invention may be applied. It has a generally cylindrical body, with a plunger switch 20 at its back and a light bulb 22 at its tapered forward end. Conventional penlight-size batteries AA are contained in the cylindrical body.

Fitted over the tapered forward end of penlight 18 is a generally cylindrical plastic sleeve 24 having a reduced opening or window 26 at its forward end and a three-layer filter element 10 mounted within said cylindrical sleeve across window 26.

It will be understood that plastic sleeve 24 may be slipped on and off conventional penlights as exemplified by penlight 18, thereby converting any conventional penlight to a portable safelight for darkroom use. When switch 20 is actuated to energize bulb 22, light from said bulb will pass through filter element 10 in sufficient quantity or intensity to illuminate the work of a darkroom, but insufficient in quantity or intensity to fog the light-sensitive materials being processed. This statement is, of course, predicated on the assumption that the penlight will be judiciously used to avoid excessive exposure of the light-sensitive materials. This would mean spacing the penlight from the work as far as possible while still permitting adequate illumination for inspection purposes. It would also mean limiting the exposure time to the minimum compatible with adequate inspection.

Although the embodiment of invention illustrated in FIGS. 2 and 3 is exemplified by a penlight, any conventional flashlight, preferably low-powered, may be used, including the larger flashlights which employ C-size and D-size batteries.

Figure 4:
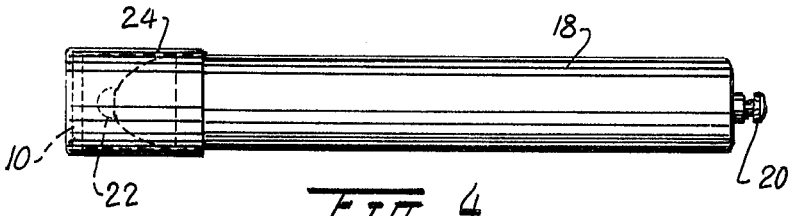
FIG. 4 is a side view of a portable safelight in the form of a battery-powered penlight, said safelight embodying the combination of filter layers shown in FIG. 1.
Figure 5:
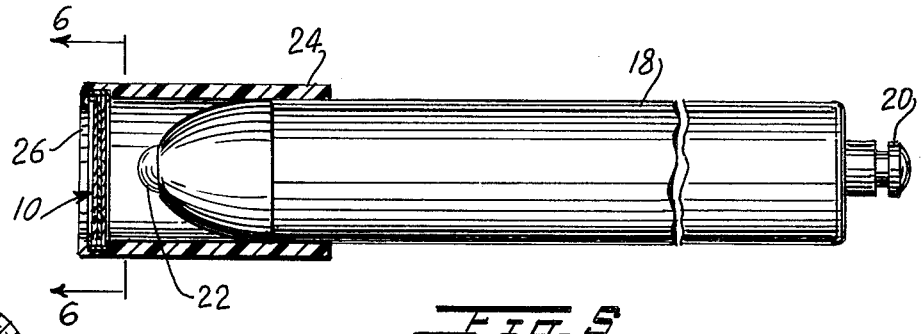
FIG. 5 is an enlarged view of the penlight shown in FIG. 4, the filter holder on said penlight being shown in section to reveal the several filter layers.
Figure 6:
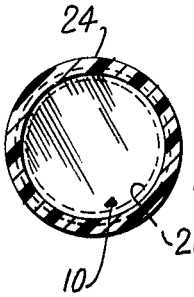
FIG. 6 is a transverse section on the line 6—6 of FIG. 5.
Figure 7:
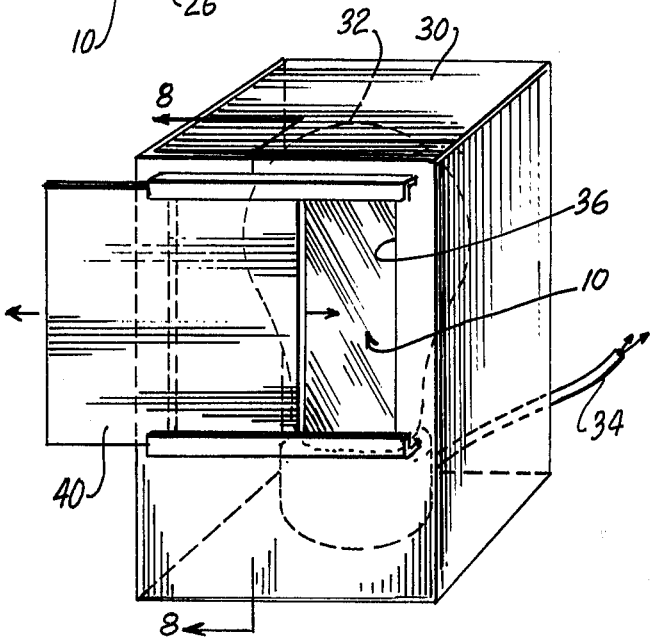
FIG. 7 is a perspective view of a more permanently mounted safelight made in accordance with the present invention, the light source being a standard incandescent lamp mounted within a fixture-type enclosure, the filter layers being supported in a window formed in said enclosure.
Figure 8:
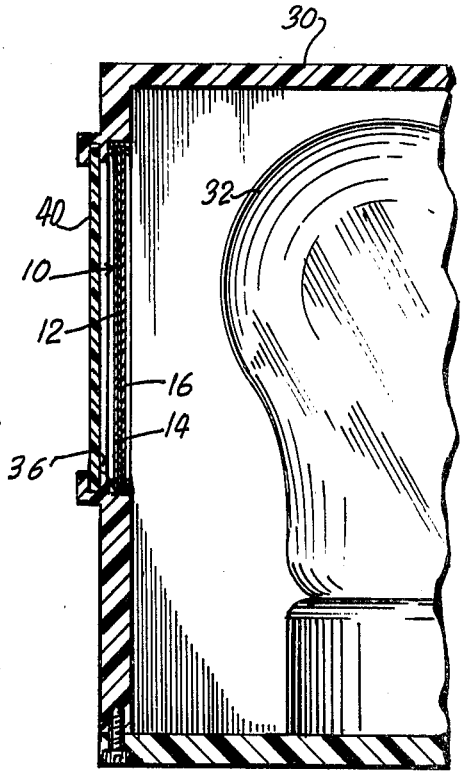
FIG. 8 is an enlarged fragmentary section on the line 8—8 of FIG. 7.

The embodiment of invention shown in FIGS. 4 and 5 is intended to exemplify the application of the invention to a generally permanently installed fixture 30. This fixture may be mounted on a work table, or it may be supported on a wall or suspended from a ceiling or otherwise mechanically mounted for darkroom use and it may, for example, be focused upon a reflective surface such as a ceiling or wall. It contains a low-wattage lamp 32 of approximately 15-watt rating, and suitable wiring 34 connects the lamp to a conventional source of electric power such as a household or laboratory circuit.

Fixture 30 is adapted to function as a standard darkroom safelight. It has a window 36 and a filter assembly 10 mounted across the window. As FIG. 5 clearly shows, filter assembly 10 in safelight 30 comprises the same filter layers 12, 14 and 16 which are shown in FIG. 1. This is also true of filter assembly 10 in plastic sleeve 24 of penlight 18. A slidable light baffle 40 may be mounted across the window to vary and control the amount of light which would be transmitted from the light source through the filter assembly.

The degree of effectiveness of my filter system can be understood from the conditions of actual darkroom use to which it has been put. As an illustration, a darkroom safelight of the type shown in FIGS. 4 and 5 was made with a 15-watt lamp and a 2¼ × 2¼ inches window covered with a filter assembly consisting of a double layer of negative film filter 12, 30% density magenta filter 14 and 60% density cyan filter 16. The safelight was supported (suspended) three feet below the darkroom ceiling and four feet from the work area. During a brief illumination of color paper under these conditions, of sufficient duration (fifteen seconds) for an adequate inspection of the paper, there was no perceptible fogging of the color paper. It will, of course, be understood that a longer period of illumination (for as long as four minutes) would be feasible without perceptible fogging, especially following partial completion of the developing process.

I have found that for a given light source and under given conditions, such as a 15-watt incandescent lamp held at a distance of four feet from the work area and exposed through a 2¼ × 2¼ inches aperture for a period of one minute, the following filter combinations will transmit the greatest amount of visible light without fogging the work:

| | Filter 12 | Filter 14 | Filter 16 |
|---|---|---|---|
| (a) | Negative film 1–2 layers | Magenta 10–60% | Cyan 10–120% |
| (b) | Negative film 1–2 layers | Magenta 10–60% | Yellow 10– 65% |

The percentage figures given are approximate density values. For example Kodak Color Printing Filter CP10M will serve as magenta color filter 14 of 10% density as indicated in row (a) above. Three layers of Kodak Color Printing Filters superimposed upon each other, would serve as magenta color filter 14 of 60% density, also as indicated in row (a). In the same row (a), cyan color filter 16 of 120% density is intended to refer to multiple layers of lower density, for example, three layers of Kodak Color Printing Filter CP40C. Similarly a red filter of 60–115% density may be used in place of a magenta filter of 30–50% density and yellow filter of 30–65% density. In such case, multiple layers of Kodak Color Printing Filter CP-R would be used, ranging from three layers of CP20R (totalling 60% density) to two layers of CP20R, one layer of CP10R, and one layer of CP05 (totalling 115% density). Thus, for the purposes of the claims, a reference, for example, to a magenta filter of 10–60% density in combination with a yellow filter of 10–65% density, is intended to encompass a red filter of 20–125% density. Similarly, a reference in the claims to a magenta filter of 10–60% density in combination with a cyan filter of 10–120% density, is intended to encompass a blue filter of 20–180% density.

In each of the examples given in the above table, the use of a single layer of negative film (filter 12) will yield good inspection illumination, but the use of two layers will provide better inspection illumination. In each of the examples, the lower color filter densities will provide better illumination than the higher densities. Densities below the stated ranges will tend to fog the work unless the intensity of the light source is reduced or the exposure time is curtailed. In either case, inspection will be hampered. Densities above the stated ranges will tend to reduce illumination of the work and thereby hamper inspection, unless the intensity of the light source is increased. The optimum ranges of density values, in approximate terms, are given in the above table, with the understanding that the lower densities are preferred.

The foregoing is illustrative of preferred combinations exemplifying the present invention and it will be understood that other combinations, perhaps less preferred but nevertheless feasible and functional, may be used within the scope of the principles of the invention and the coverage of the appended claims.

I claim:

1. In a darkroom safelight for color film processing, having a light source, an enclosure for said light source and a window in said enclosure through which light is transmitted from the light source, a light filter extending across said window, said light filter comprising a plurality of superposed filter layers, namely:

a. a first filter comprising at least one layer of color negative film exposed to white light and developed with color developer, b. a second filter comprising at least one layer of magenta color filter with a minimum density of approximately 10%, and c. a third filter comprising at least one layer of color filter with a minimum density of approximately 10%, d. said third filter being of a complementary subtractive color relative to the color magenta.

2. The combination of claim 1, wherein:

a. the second filter comprises at least one layer of magenta color filter with a combined maximum density of approximately 60%, and b. the third filter comprises a cyan color filter with a maximum density totalling approximately 120%.

3. The combination of claim 1 wherein:

a. the first filter comprises two layers of color negative film exposed to white light and developed with color developer, b. the second filter comprises a magenta color filter with a minimum density of approximately 10% and a maximum density totalling approximately 60%, and c. the third filter comprises a cyan color filter with a minimum density of approximately 10% and a maximum density totalling approximately 120%.

4. The combination of claim 1, wherein:

a. the first filter comprises two layers of color negative film exposed to white light and developed with color developer, b. the second filter comprises a magenta color filter with a minimum density of approximately 10% and a maximum density totalling approximately 60%, and c. the third filter comprises a yellow color filter with a minimum density of approximately 10% and a maximum density totalling approximately 65%.

5. The combination of claim 1, wherein:

the light source and enclosure therefor consist of a portable battery-powered flashlight.

6. The combination of claim 1, wherein:

the light source and enclosure therefor consist of a light fixture mechanically supported in a darkroom and containing an incandescent lamp of low power, of the order of 15 watts.

7. The combination of claim 1, wherein:

the third filter comprises at least one layer of cyan color filter with a minimum density of approximately 10%.

8. The combination of claim 1, wherein:

the third filter comprises at least one layer of yellow color filter with a minimum density of approximately 10%.

9. The combination of claim 1, wherein:

the second filter comprises at least one layer of magenta color filter with a maximum density totalling approximately 60%, and b. the third filter comprises a yellow color filter with a maximum density totalling approximately 65%.

* * * * *